United States Patent [19]

Schewe

[11] 4,133,493

[45] Jan. 9, 1979

[54] SELF-THREADING TENSION COMPENSATOR

[75] Inventor: Richard A. Schewe, Loves Park, Ill.

[73] Assignee: Barber-Colman Company, Rockford, Ill.

[21] Appl. No.: 892,552

[22] Filed: Apr. 3, 1978

[51] Int. Cl.[2] ..... B65H 59/26

[52] U.S. Cl. ..... 242/154

[58] Field of Search ..... 242/154, 153, 147 R, 242/45

[56] References Cited

U.S. PATENT DOCUMENTS

| | | | |
|---|---|---|---|
| 2,104,809 | 1/1938 | O'Dowd | 242/154 X |
| 2,326,714 | 8/1943 | Wholton | 242/154 |
| 2,685,417 | 8/1954 | Bartelson | 242/154 X |
| 2,833,491 | 5/1958 | Carroll | 242/154 |
| 3,080,132 | 3/1963 | Fisher et al. | 242/154 |
| 3,295,788 | 1/1967 | Richter | 242/154 |

FOREIGN PATENT DOCUMENTS

| | | | |
|---|---|---|---|
| 1222209 | 1/1960 | France | 242/154 |
| 627044 | 10/1961 | Italy | 242/154 |
| 22908 | 11/1900 | Switzerland | 242/154 |

*Primary Examiner*—Stanley N. Gilreath
*Attorney, Agent, or Firm*—A. Richard Koch

[57] ABSTRACT

A tension compensator for use on a package winder has two spaced pins projecting from a rotatable member, the pins being parallel to the axis. The member is biased to rotate in a predetermined direction to a stop, so that a strand passed between and over said pins in zig-zag fashion moves the pins against the bias to straighten the strand under higher tension and permits the bias to move the pins to store the strand under lower tension. The compensator is made self-threading by providing a ramp to deflect the strand over the end of one pin when traversing past the pin in one direction, and a strand-guide to deflect the strand over the extremities of both pins and the ramp on the initial traversal of the strand in the opposite direction.

6 Claims, 10 Drawing Figures

SELF-THREADING TENSION COMPENSATOR

BACKGROUND OF THE INVENTION

When packages are formed by winding a strand in a helix on a core, the length of strand between the supply and the package is not constant, because the distances from the supply to the ends of the package are greater than the distance to intermediate locations. This results in uneven tension in the strand on the package, which may produce undesirable changes in the physical properties of the strand such, for example, as yarn. When the core is a cone, this condition is exaggerated, because the peripheral speed of the core varies continuously from one end to the other even though the angular velocity is constant. This condition is even more serious in the winding of yarn produced by open-end spinning, in which yarn is spun at a fixed rate determined by the speed of the yarn withdrawal rolls.

In order to remedy this problem, tension compensators have been employed to store strand when the tension is low and to release it from storage when the tension is high. Many such compensators have two spaced pins mounted on a member rotatable about a fixed axis, the pins being parallel to and on opposite sides of the axis. The member is biased to rotate in a predetermined direction and the strand between the supply and the package is threaded over one pin and under the other in such a zig-zag manner that tension in the strand exerts a force on the pins tending to rotate the member in opposition to its bias. The bias is adjusted such that it overcomes the force of the strand on the pins when tension is low, thereby storing strand, and the bias is overcome by the force of the strand on the pins when tension is high, thereby releasing strand from storage.

In the past threading of the strand through the tension compensator was accomplished manually, which consumed a considerable amount of time, especially when starting-up winding machines on which large numbers of packages are formed.

SUMMARY

According to the present invention threading of a tension compensator of the type described is accomplished automatically as a strand is traversed back and forth across the core by means of the addition of a strand-guide to deflect the strand beyond the ends of the pins as the strand makes its initial traverse in one direction, and of a ramp to deflect the strand over the end of the second pin encountered as the strand makes the next traverse in opposite direction.

DESCRIPTION OF THE PREFERRED EMBODIMENT

Figure 1:
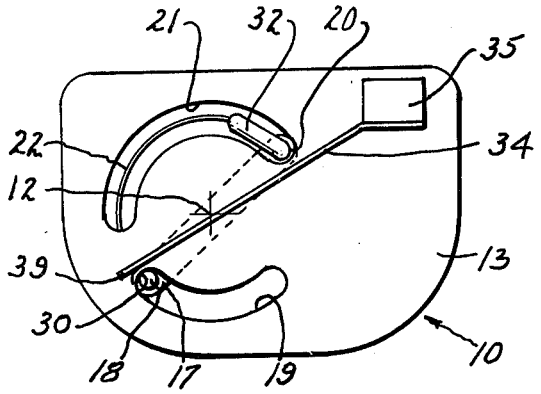
FIG. 1 is a front elevation of a preferred self-threading tension compensator according to this invention.
Figure 2:
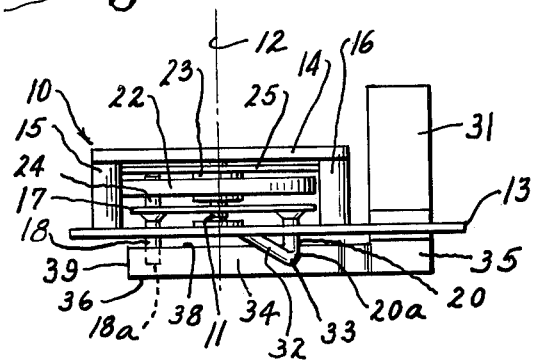
FIG. 2 is a top view of the compensator in FIG. 1.
Figure 3:
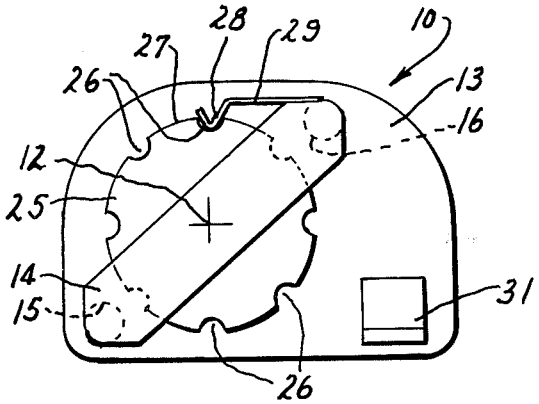
FIG. 3 is a back elevation of the compensator in FIG. 1.

A preferred embodiment of this invention is shown in FIGS. 1–3 as the self-threading tension compensator 10. In it a pivot shaft 11 rotates freely about an axis 12 between a base 13 and a parallel bar 14. The bar is held in spaced relation to the base by columns 15, 16. A member 17, rotatable about axis 12, is fixed on the pivot shaft 11. A projection 18, shown as a pin or rod, extends from the member and through an arcuate slot 19 in the base in spaced parallel relation to the axis. The projection is hardened to resist wear and polished to present a smooth, non-abrasive strand-engaging surface. A shoulder 20, shown as a portion of a formed rod, is located diametrically opposite to the projection on the member 17 and extends through an arcuate slot 21 in the base in spaced parallel relation to the axis. A biasing means is shown as a clock spring 22, which has one end affixed to a hub 23 freely rotatable about pivot shaft 11 and the other end connected to a rearward extension 24 of projection 18. The hub extends perpendicularly from a disc 25 having a plurality of spaced notches 26 in its periphery 27 for selectively receiving a detent 28 on the end of a leaf spring 29 cantilevered between bar 14 and column 16. The clock spring 22 is installed such that the member 17 and its attached projection 18 and shoulder 20 are biased to rotate clockwise, as seen in FIG. 1. Clockwise rotation is limited by a stop 30, shown as the end of arcuate slot 19, upon contact by projection 18. The tension in clock spring 22 may be increased by rotating the disc 25 counter-clockwise, as seen in FIG. 3, and decreased by rotating the disc clockwise. The disc is retained in a selected position by detent 28, being pressed against periphery 27 by leaf spring 29, becoming engaged with a selected one of the notches 26, thereby determining the tension in clock spring 22. A bracket 31 is provided for mounting the compensator. The apparatus so far described is known in the prior art.

The improvement comprises a ramp 32 rigidly connected to the member 17 and sloping downward from an outermost extremity 33, located over and beyond the outermost extremity **20*a* of shoulder 20, through the arcuate slot 21 in counterclockwise direction, as seen in FIG. 1. The ramp has a strand-engagable length between the plane of base 13 and the outermost extremity 33. This engagable length may be curved in a fixed radius from the axis or may lie in a plane substantially parallel to the axis and through a chord of a circle centered on the axis. As shown, the ramp is integral with the shoulder to form a single protrusion from the member. Both the ramp and shoulder are hardened to resist wear and polished to present a smooth nonabrasive surface for engagement with a strand. A strand-guide 34 is cantilevered from base 13 at fixed end 35 in a location adjacent to shoulder 20, but spaced further from the axis 12, and passes between projection 18 and shoulder 20. The strand-guide lies parallel to the base, with a smooth outside 36 beyond the outermost extremities 18*a*, 33 of the projection and the ramp, as measured from the base. The inside 38 of the strand-guide is spaced from the base. The free end 39 of the strand-guide extends beyond the projection 18**.

Figure 4:
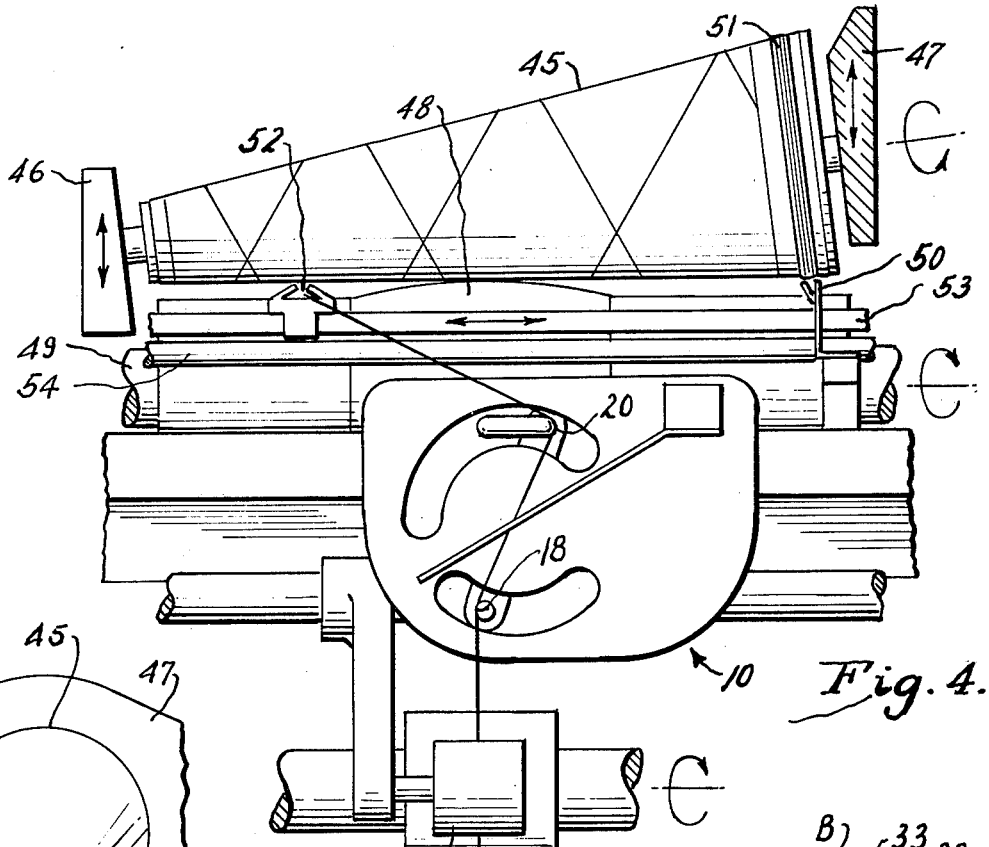
FIG. 4 is a front elevation of a winding station, comprising a self-threading tension compensator according to this invention, on an open end spinning machine.
Figure 5:
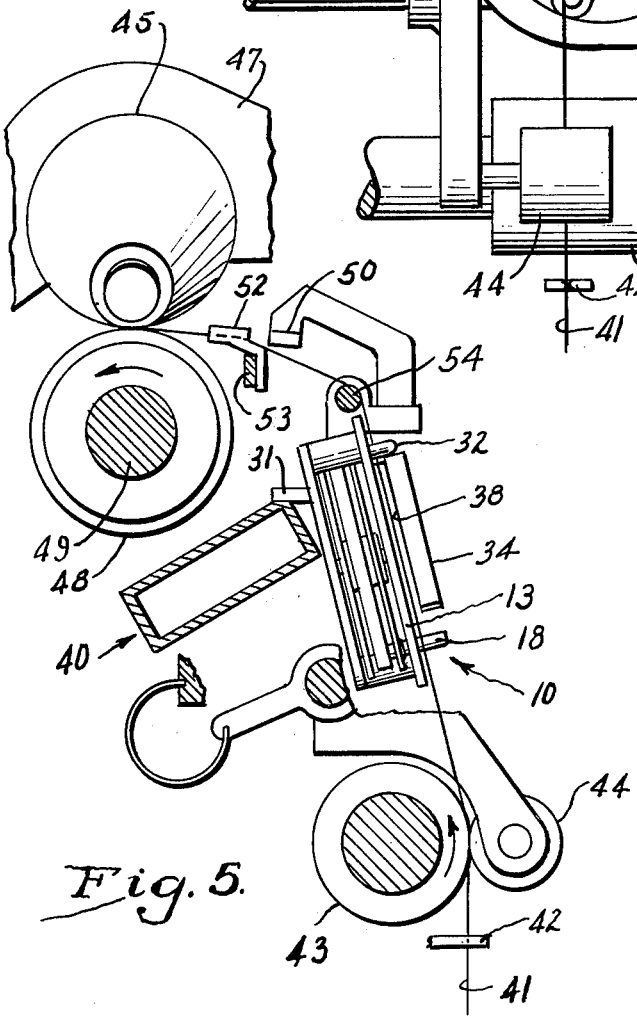
FIG. 5 is an end view of the winding station in FIG. 4 with the near arm removed.

In FIGS. 4 and 5, a self-threading tension compensator 10 is mounted at a winding station on an open end spinning machine. It is mounted by bracket 31 on a third hand 40. Yarn 41 being spun in an open end spinning rotor (not shown) is drawn therefrom through a fixed guide 42 at a constant speed by withdrawal rolls 43, 44, of which 43 is driven and 44 is a pressure roll. A conical core 45, on which the yarn is being wound to form a package, is pivotally supported for free rotation between arms 46, 47 and is frictionally driven intermediate its ends by an annular raised portion 48 concentric with and connected to drive shaft 49. A fixed open-sided yarn guide 50, adjacent the large end of core 45, is employed to guide yarn 41 while forming a creeling tail 51. A traversing open-sided yarn guide 52, affixed to a reciprocating traversing rod 53, provides the helix angle for the yarn being wound on the core 45 to form a package. A guide rod 54 assists in positioning the yarn as it moves through the tension compensator 10. As shown the yarn 41 is passed through fixed guide 42, between withdrawal rolls 43, 44, over projection 18, shoulder 20 and guide rod 54, and through traversing yarn guide 52 to the core 45 such that increased tension in the yarn exerts sufficient force on projection 18 and shoulder 20 to rotate member 17 counterclockwise, against its bias, to release some of the stored yarn. It will be noted that between the withdrawal rolls 43, 44 and guide rod 54, as shown in FIG. 5, the yarn 41 lies in a plane tangent to guide rod 54 and to drive roll 43, and that this plane, and the yarn, passes between the base 13 and the inside 38 of strand-guide 34 during helical winding.

Figure 6:
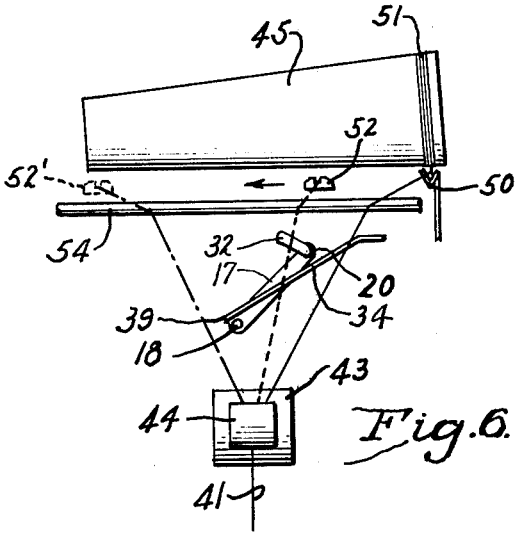
FIG. 6 is a partial front elevation of the tension compensator in FIG. 1, showing only the relationship of components essential to the understanding of the action on the initial traverse of the yarn from the large to the small end of the cone.

While a creeling tail 51 is being wound on core 45, the yarn 41 passes from the withdrawal rolls 43, 44 over the outside 36 of strand-guide 34, over the guide rod 54 and through the fixed yarn guide 50 to the core 45 as shown by a solid line in FIG. 6. After the creeling tail is wound, the yarn 41 is manually transferred from fixed yarn guide 50 into traversing yarn guide 52, so that, as shown in a dashed line in FIG. 6, the yarn passes from the withdrawal rolls 43, 44 over the outside 36 of strand-guide 34, over guide rod 54, through the traversing guide 52 to the core 45, as the traversing guide moves the yarn to the free end 39 of the strand-guide. Beyond the free end, the yarn 41 passes in a straight line from the withdrawal rolls 42, 43 to the guide rod 54 and then through the traversing guide, as at 52', to the core 45, as shown in long and short dashed lines in FIG. 6.

Figure 7:
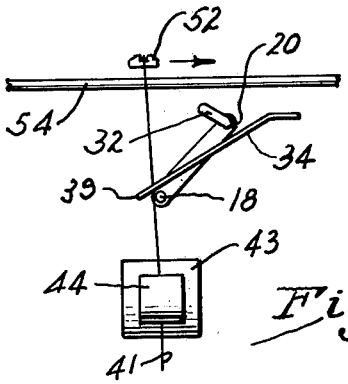
FIGS. 7–9 are views similar to FIG. 6, showing the successive relationships of the components while the yarn is being initially traversed from the small to the large end of the core.
Figure 8:
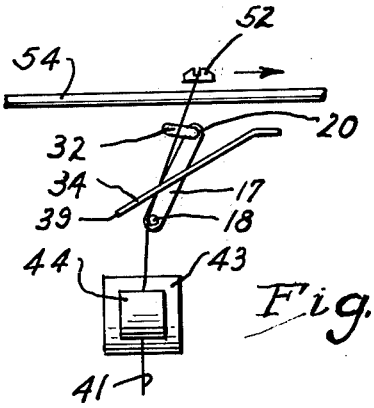
Figure 10:
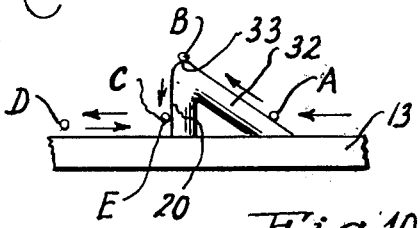
FIG. 10 is a fragmentary view showing the path of the yarn as it is deflected by the ramp and brought into engagement with the shoulder.
Figure 9:
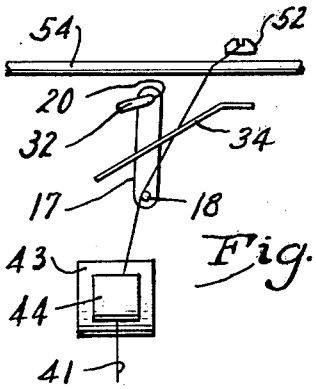

When the traversing guide 52 reverses direction and moves toward the large end of the core 45, the yarn 41 passes beneath the strand-guide 34 as it moves in a straight line between the withdrawal rolls 43, 44 and guide rod 54, and engages the projection 18, as shown in FIG. 7. The tension in yarn 41 exerts a force on projection 18, causing the member 17 to move in opposite to the predetermined direction established by the bias means so that the yarn engages the ramp 32, as shown in FIG. 8 and at position A in FIG. 10. As the traversing guide 52 moves the yarn 41 further toward the large end and member 17 is rotated farther against its bias, the yarn is deflected from the plane tangent to the driven roll 43 and the guide rod 54 by the ramp 32, as shown in FIG. 10, until it reaches position B at the outermost extremity 33 of the ramp. Beyond position B the yarn is straightened by tension to assume a position C adjacent to but not exerting pressure on shoulder 20. Upon further rotation of member 17 as a result of force exerted upon projection 18 by the tension in yarn 41, the ramp 32 and shoulder 20 are moved away from the yarn, as seen in FIG. 9 and at position D in FIG. 10. When the traversing guide 52 again reverses direction, the yarn 41 is brought into engagement with shoulder 20 at position E in FIG. 10, at which time threading of the tension compensator is completed and operation of the tension compensator is the same as in the prior art.

It will be obvious to those skilled in the art that many substitutions and modifications may be made in the described preferred embodiment without departing from the teachings of this invention. The described embodiment is exemplary only and does not define the limits of this invention.

I claim:

1. A self-threading tension compensator for use in package winding, said compensator comprising a fixed axis, a member rotatable about said axis, means for biasing the member to rotate in a predetermined direction about the axis, a stop limiting rotation of said member in the predetermined direction, a projection of said member spaced from the axis, a smooth thread-engaging surface on said projection extending substantially parallel to the axis, a smooth thread-engaging shoulder extending from said member in the same direction as said projection and substantially parallel to said axis, and characterized by a smooth thread-guiding ramp sloping downward from a position over and beyond the outermost extremity of said shoulder in opposite to the predetermined direction of rotation, and a thread-guide cantilevered in a fixed spaced relation to the axis at a location adjacent and beyond the motion limiting position of said shoulder with respect to the axis, said thread-guide passing between and extending across the paths of said projection and said shoulder, an outside of said thread-guide farther from said member than the outermost extremities of said projection and said ramp, said thread-guide terminating in a free end farther from the axis than said projection in motion limiting position.

2. A tension compensator according to claim 1 wherein said shoulder and said ramp are parts of a single protrusion from said member.

3. A tension compensator according to claim 2 wherein said protrusion is a formed rod.

4. A tension compensator according to claim 1 wherein the engagable length of said ramp is at substantially a fixed radius from the axis.

5. A tension compensator according to claim 1 wherein the engagable length of said ramp lies substantially in a plane parallel to the axis and through a chord of a circle centered on the axis.

6. A tension compensator according to claim 1 wherein said projection and said shoulder are diametrically opposite each other with respect to said axis.

* * * * *

UNITED STATES PATENT OFFICE

CERTIFICATE OF CORRECTION

Patent No. 4,133,493 Dated January 9, 1979

Inventor(s) Richard A. Schewe

It is certified that error appears in the above-identified patent and that said Letters Patent are hereby corrected as shown below:

In column 4, line 30, change "thread-engaging" to --strand-engaging--, line 32, change "thread-engaging" to --strand-engaging--.

line 35, change "thread-guiding" to --strand-deflecting--, line 38, change "thread-guide" to --strand-guide--, line 41, change "thread-guide" to --strand-guide--, line 43, change "thread-" to --strand- --, and line 46, change "thread-guide" to --strand-guide--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*